US012759744B2

(12) United States Patent
Rolleri et al.

(10) Patent No.: US 12,759,744 B2
(45) Date of Patent: Oct. 13, 2026

(54) DEVICE AND METHOD FOR EVACUATING AIR FROM A PACKAGE

(71) Applicant: ILAPAK ITALIA S.P.A., Foiano della Chiana (IT)

(72) Inventors: Stefano Rolleri, Foiano della Chiana (IT); Emanuele Sarcoli, Foiano della Chiana (IT); Paolo Rubbini, Foiano della Chiana (IT)

(73) Assignee: ILAPAK ITALIA S.P.A., Foiano della Chiana (IT)

( * ) Notice: Subject to any disclaimer, the term of this patent is extended or adjusted under 35 U.S.C. 154(b) by 0 days.

(21) Appl. No.: 19/135,433

(22) PCT Filed: Dec. 5, 2023

(86) PCT No.: PCT/EP2023/084235
§ 371 (c)(1),
(2) Date: Jun. 4, 2025

(87) PCT Pub. No.: WO2024/141223
PCT Pub. Date: Jul. 4, 2024

(65) Prior Publication Data

US 2026/0070693 A1 Mar. 12, 2026

(30) Foreign Application Priority Data

Dec. 28, 2022 (IT) ..... 102022000026988

(51) Int. Cl.
*B65B 31/04* (2006.01)

(52) U.S. Cl.
CPC ..... *B65B 31/048* (2013.01)

(58) Field of Classification Search
CPC ... B65B 31/041; B65B 31/042; B65B 31/048; B65B 31/06; B65B 31/04; B65B 31/043
(Continued)

(56) References Cited

U.S. PATENT DOCUMENTS 3,430,414 A * 3/1969 Ludwig ..... B65B 31/06 53/512
4,418,513 A * 12/1983 Plahm ..... B65B 31/042 53/481

(Continued)

FOREIGN PATENT DOCUMENTS

CN 105752392 * 7/2016 ..... B65B 31/04
EP 2993138 A2 3/2016

OTHER PUBLICATIONS

PCT International Search Report for corresponding International Application No. PCT/EP2023/084235 mailed Feb. 29, 2024.

(Continued)

*Primary Examiner* — Linda J. Hodge
(74) *Attorney, Agent, or Firm* — Barclay Damon LLP

(57) ABSTRACT

A device for the evacuation air from a package for a packaging apparatus. The apparatus includes a conveyor system having a plurality of conveying means configured to move said package through at least one processing station. The apparatus further includes an insufflation system comprising a gas supply unit, a gas transport pipeline connected to said gas supply unit and at least one rotating head positioned in said processing station and configured to rotate about a rotation axis wherein the rotating head is provided with at least one nozzle connected to said gas transport pipeline and having a body extending along a longitudinal axis substantially perpendicular with respect to the rotation axis, with a proximal end attached to the rotating head and a distal end provided with an insufflation orifice to enable the introduction of gas inside the package moving along a processing direction while the least one nozzle rotates.

13 Claims, 7 Drawing Sheets

(58) Field of Classification Search
USPC ..... 563/510, 512
See application file for complete search history.

(56) References Cited

U.S. PATENT DOCUMENTS

| | | | | |
|---|---|---|---|---|
| 5,435,114 | A | 7/1995 | Moehlenbrock et al. | |
| 2007/0074492 | A1* | 4/2007 | Koga | B65B 5/061 53/512 |
| 2008/0247682 | A1 | 10/2008 | Murray | |
| 2018/0319523 | A1* | 11/2018 | Palumbo | B65B 51/16 |
| 2020/0115079 | A1* | 4/2020 | Prestine | B65B 65/02 |
| 2020/0189780 | A1* | 6/2020 | Sago | B65B 43/465 |
| 2021/0292017 | A1* | 9/2021 | Oshima | B65B 31/042 |
| 2025/0083890 | A1* | 3/2025 | Murray | B65B 31/042 |

OTHER PUBLICATIONS

Written Opinion of the PCT International Searching Authority for corresponding International Application No. PCT/EP2023/084235 mailed Feb. 29, 2024.

* cited by examiner

DEVICE AND METHOD FOR EVACUATING AIR FROM A PACKAGE

CROSS REFERENCE TO RELATED APPLICATIONS

This application is a U.S. National Stage Application under 35 U.S.C. § 371 of International Application No. PCT/EP2023/084235 filed on Dec. 5, 2023, which claims priority to Italian Application No. 102022000026988 filed on Dec. 28, 2022, both of which are incorporated herein by reference in their entirety.

TECHNICAL FIELD

The present invention relates to a device for evacuating air from a package for a packaging apparatus and a method for evacuating air from a package. This type of apparatus can be used to package a food product and must generally guarantee a packaging that allows the product to be stored well over time. According to this, it is necessary to eliminate or at least minimise the amount of air that remains in contact with the food product inside the package during storage.

BACKGROUND

Devices for the evacuation of air are known to comprise a conveyor system configured to move the package along a processing line in which an insufflation system is arranged, the latter comprising one or more insufflation heads each equipped with at least one nozzle capable of insufflating gas to evacuate air from within the package. Generally, evacuation of air from the package consists of extracting oxygen before the package has been closed and may generally refer to extraction of air (i.e. a gas mixture corresponding to ambient air). In the context of this invention, one or a mixture of protective gases (also called 'inert' gas) is insufflated in the internal volume of the package. Known protective gas are CO2 and N2. The process of actively modifying the atmosphere surrounding the product within the package is generally referred to as modified atmosphere packaging or MAP.

As it is known, gas is insufflated inside the package onto the free space above the product. The insufflated gas takes the place of the air that has been evacuated from the package and the package is then sealed, ensuring that the residual O2 level inside the package does not exceed a tolerated value. As already mentioned, reducing the O2 level in the package is particularly advantageous when products are easily perishable. In some applications, a residual O2 level of 5% to 6% may be sufficient. In other applications, a residual O2 level of less than 5%, e.g. 1% or less, may be desirable.

For this purpose, in known gas injection insufflation systems, the insufflation heads are moved to allow the nozzle to enter the package and to inject gas into it.

According to a particular configuration in known air evacuation devices, the gas injection occurs in a continuous manner, according to which the nozzle enters the interior of the package through an opening of the package, while the package is moved. The insufflation head is moved to allow the nozzle to enter the package and insufflate gas into the package.

A disadvantage of known devices is that it is difficult to evacuate almost all the air from the package due to the time between the extraction of the nozzle and the closure of the package.

SUMMARY OF THE INVENTION

One aim of the present invention is to improve known devices for a better evacuation of air from a package, in particular devices configured to move the package during gas injection.

A second purpose of the present invention is to provide an efficient method for evacuating air from a package in such a way to drastically reduce the residual level of O2 in the packages.

A further purpose of the present invention is to speed up the process of evacuating air from a package while keeping an efficient production.

Another aim of the present invention is to provide a continuous air evacuation device that is flexible and can be used to evacuate air from a multitude kind of package of different shapes and sizes without needing to change mechanical parts.

In a first aspect of the invention, it is provided a device for evacuating air from a package 100 for a packaging apparatus 200 according to claim 1.

BRIEF DESCRIPTION OF THE DRAWINGS

The invention may be better understood with reference to the accompanying drawings which illustrate an exemplary and non-limiting embodiment in which.

DETAILED DESCRIPTION

Figure 1:
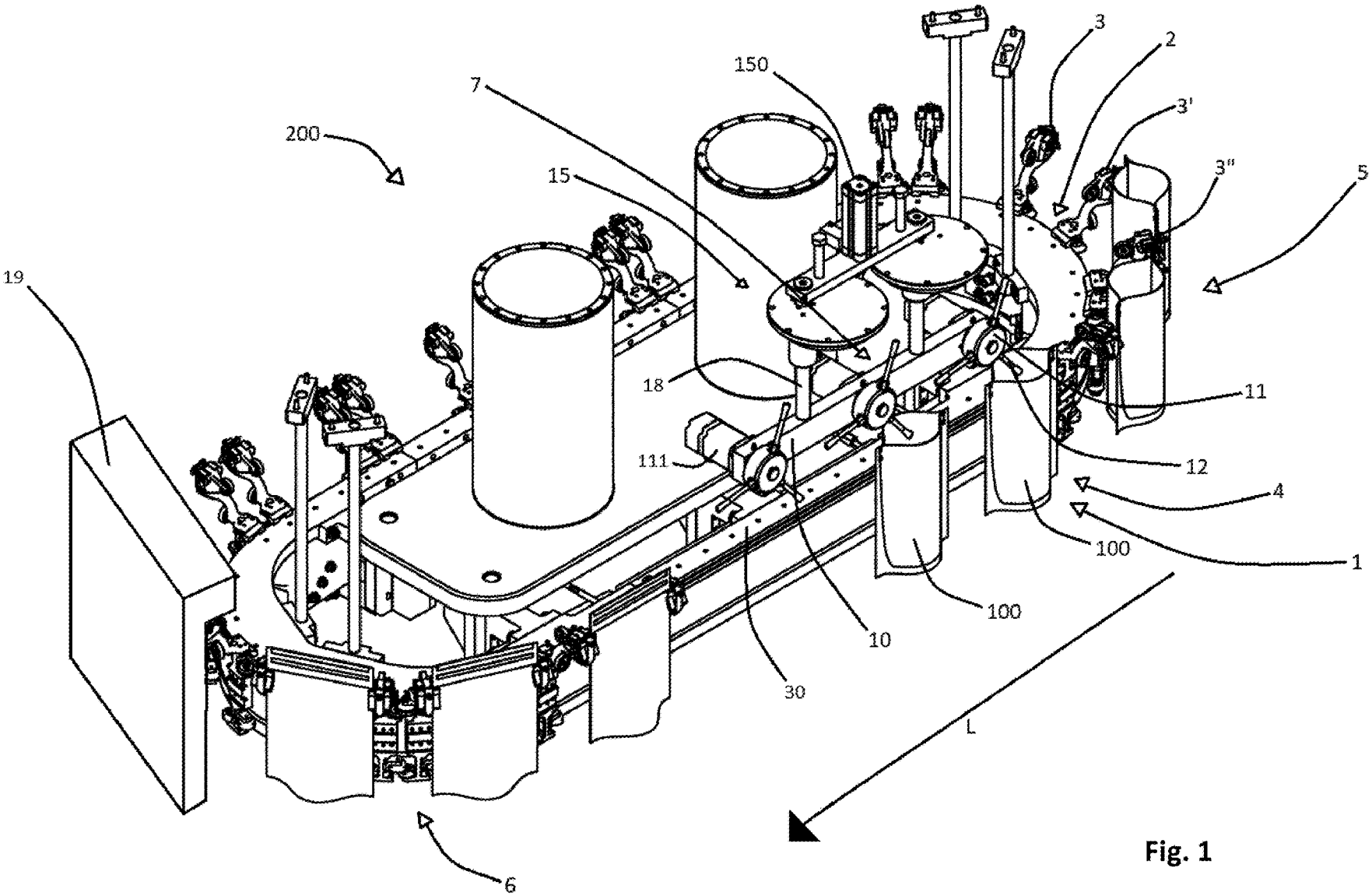
FIG. 1 is a schematic view of an apparatus using an air evacuation device from a package according to the invention.

With reference to FIG. 1, an apparatus 200 for packaging a package 100 comprising a device 1 for evacuating air from the package 100 according to the invention, arranged to contain and package products preferably foodstuffs or chemicals within it, is illustrated.

Figure 2:
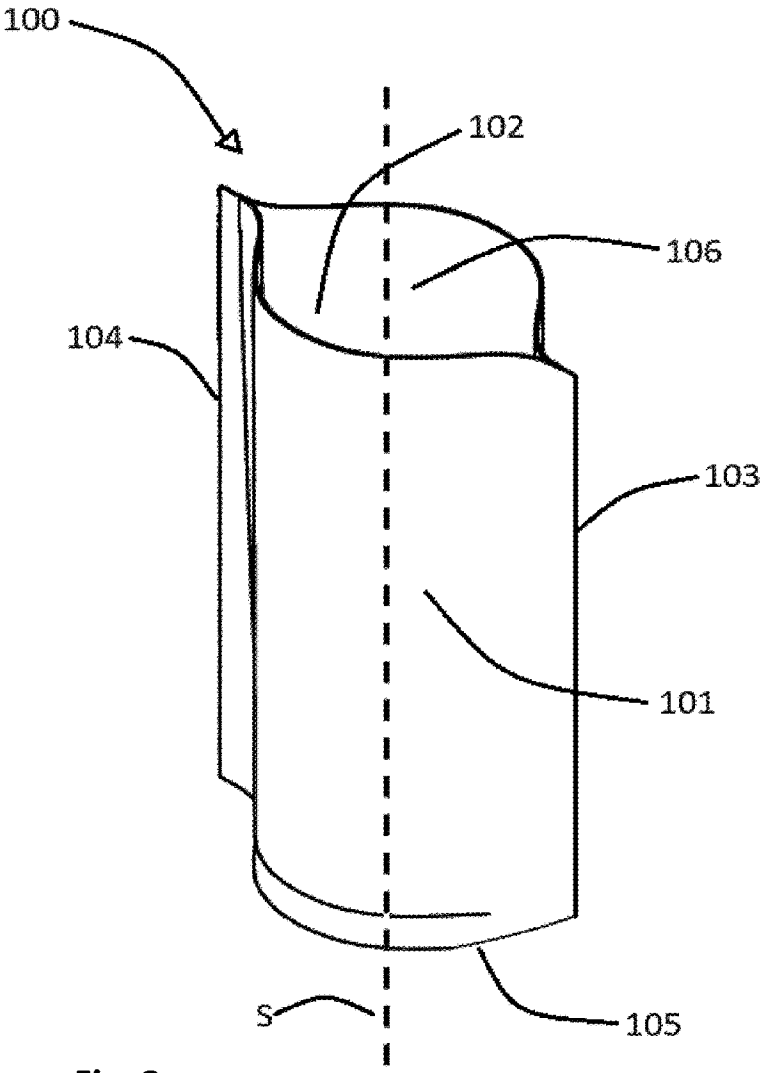
FIG. 2 is a schematic view of the package processed by the device of FIG. 1, in an open configuration.

As can be seen in FIG. 2, the package 100 processed by the device 1 comprises at least one first 101 and a second walls 102 opposed to each other and joined together along a first 103 and a second 104 lateral opposite portions and a closed bottom 105, the latter being preferably substantially perpendicular to an axis S of longitudinal development of said package, said at least a first 101 and a second walls 102 defining along their upper edge an aperture 106 opposed to the closed bottom 105; the aperture 106 preferably developing between said first 103 and second 104 lateral portions.

The device 1 for evacuating air from the package 100 includes a conveyor system 2 comprising a plurality of conveying means 3 configured to move said package 100 from an arrival zone 5 to a release zone 6 passing through at least one processing station 4, along a processing direction L.

As can be seen in FIG. 1, the conveyor system 2 according to a preferred embodiment comprises a closed track 30 and said plurality of conveying means 3 are configured to be moved along the track 30 by interaction of magnetic fields.

According to an alternative embodiment, not illustrated, the conveyor system may be implemented as a belt or chain transport system of the known type, wherein the plurality of conveying means 3, having a fixed, pre-set distance between them, move in conjunction with the movement of the belt or chain. According to a further alternative embodiment, not illustrated, the conveyor system comprises a plurality of mechanical arms, each having a handling end configured as conveying means.

The conveying means 3 are configured to receive said package 100 in said arrival zone 5 by means of appropriate feeding means not illustrated.

Figure 3:
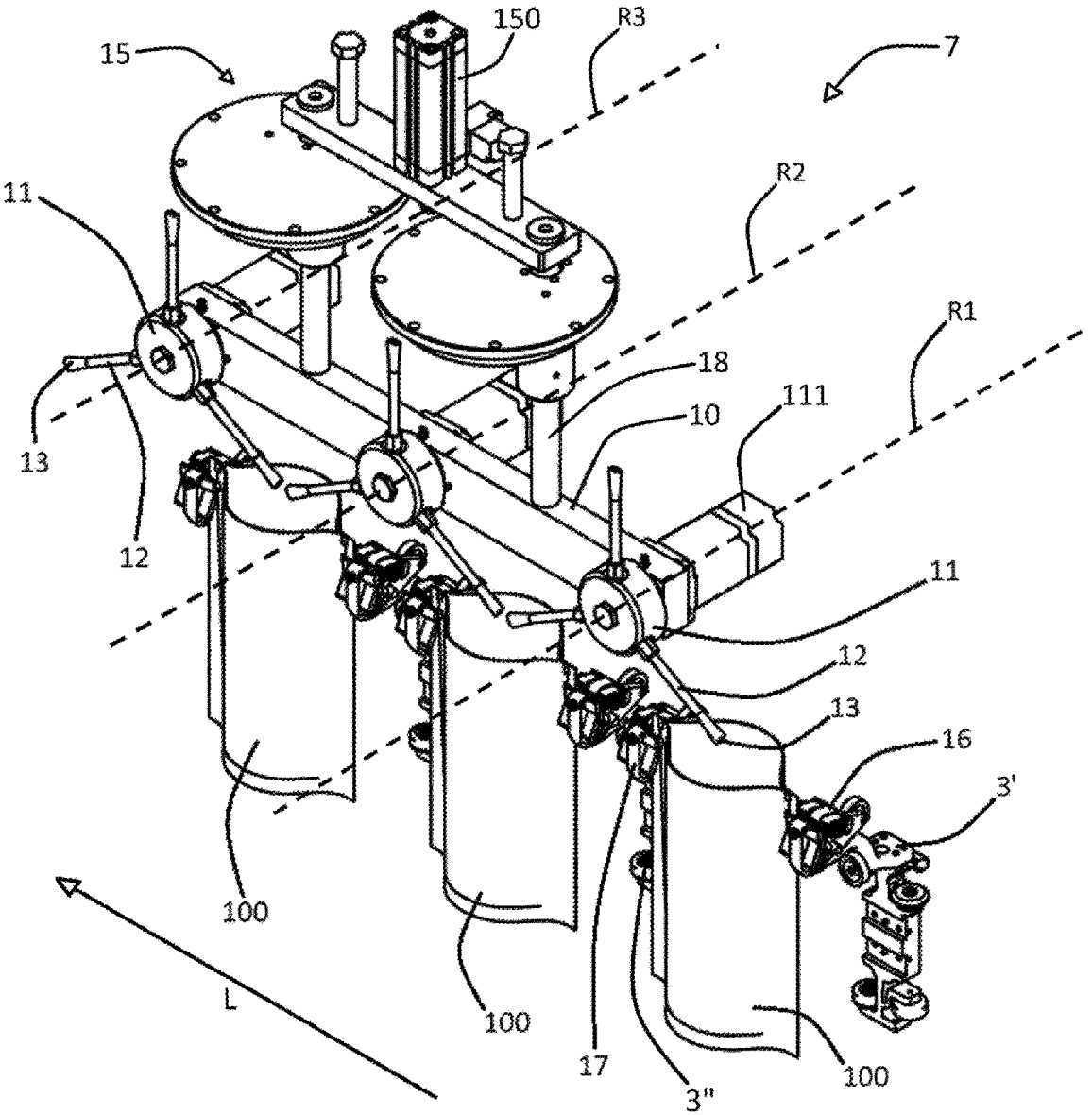
FIG. 3 is a schematic view of the air evacuation device of FIG. 1.

According to the illustrated embodiment, each package 100 is held by a pair of conveying means 3 while advancing along the processing direction L as visible in FIG. 3. Specifically, a first conveying means 3' of said pair of conveying means interacts with the first lateral portion 103 of the package 100, while a second conveying means 3" of said pair of conveying means interacts with the second lateral portion 104 of the package 100.

In the illustrated example, said conveying means 3 comprises a first gripping element 16 configured to hold said first lateral portion 103 of said package 100 and a second gripping element 17 configured to hold said second lateral portion 104 of said package 100. Said first 16 and said second 17 gripping elements are movable between an approached position and a spanned position, so as to respectively approach and distance said first and second lateral portions 103, 104 from each other to respectively open and close said aperture 106 of said package 100 during movement. According to such configuration, the first 16 and second 17 gripping elements when holding the package 100 are movable between an approached position in which the aperture 106 is kept open and a spanned position in which the first and second walls 101, 102 are neared to each other to close the aperture 106.

According to an embodiment, said first 16 and second 17 gripping elements can be predisposed both on a single conveying mean 3 of the plurality of conveying means 3. According to a different embodiment said first 16 gripping element can be associated to said first conveying means 3', while said second 17 gripping element can be associated to said second conveying means 3".

According to a different preferred embodiment, said transport means 3 comprise gripping members including lever or suction cup system of a known type which interact with one or more walls of the package 100 to open or close the aperture 106 by appropriate reciprocal movement.

The device 1 further comprises an insufflation system 7 comprising a gas supply unit 8 (shown for simplicity only in FIGS. 4-6), such as, for example, a pump, configured to supply the gas through a gas transport pipeline 9 connected to said gas supply unit 8. It is clear that the gas in order to be injected into the pipeline 9 must have a positive pressure.

The insufflation system 7 further comprises at least one rotating head 11, positioned in said processing station 4 and configured to rotate about a axis R of rotation.

According to an embodiment, the insufflation system 7 is rotatable mounted on a support 10.

Said at least one rotating head 11 is rotatably driven by a respective motor 111 (FIG. 3) with direction of rotation T and connected to said gas transport pipeline 9; the at least one rotating head 11 is provided with at least one nozzle 12 having a body extending along a longitudinal axis A substantially perpendicular with respect to the axis R of rotation, with a proximal end fixed to said at least one rotating head 11 and a distal end provided with an insufflation orifice 13. Said at least one nozzle 12 being configured to be moved following a circular trajectory while insufflating gas within the package 100.

The at least one nozzle 12 is preferably configured in an elongated tubular shape to facilitate its insertion through the aperture 106 of the package 100 and is connected to the gas transport pipeline 9 via a valve 14 (FIG. 7), which is configured to allow gas to be released from the at least one nozzle 12 preferably only when the latter enters the package 100.

Figure 7:
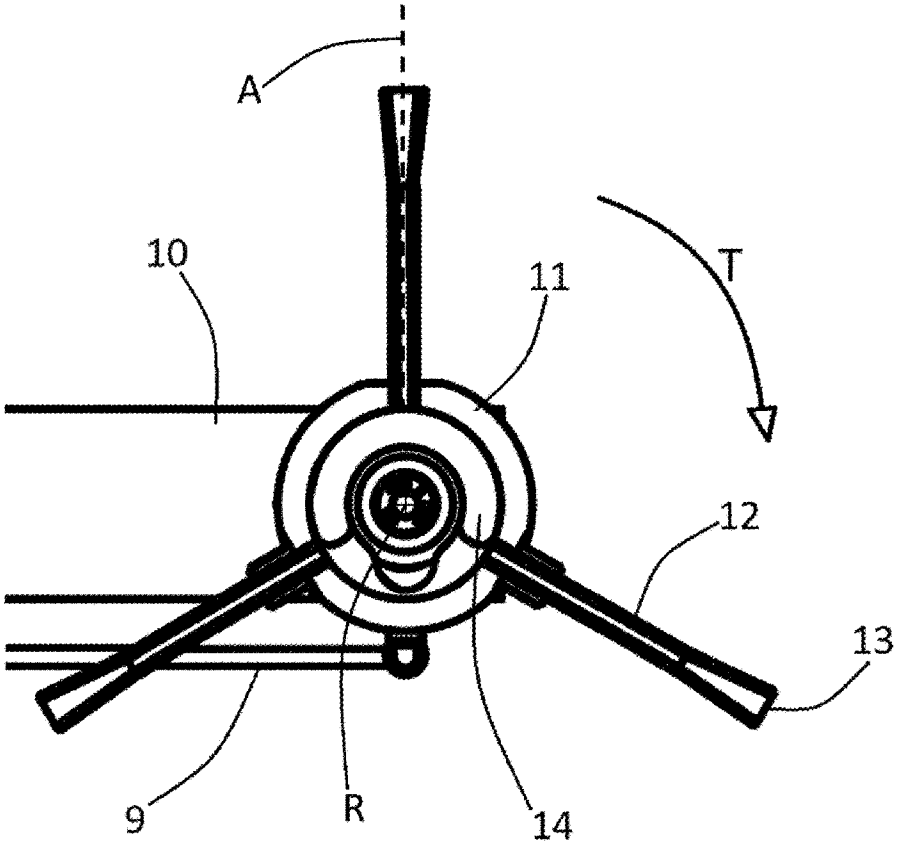
FIG. 7 is a front view of a section of a detail of the air evacuation device.

In the preferred embodiment illustrated in FIG. 7, the valve 14 is cam shaped and connects the nozzle 12 with the gas transport pipeline 9 along an arc of circumference $\alpha$. The arc of circumference $\alpha$ preferably subtending an angle between 60° and 120°.

In practice, when the at least one nozzle 12 rotates within the arc of circumference $\alpha$ the gas is released from the insufflation orifice 13, whereas when the at least one nozzle 12 is outside this arc of circumference $\alpha$ the gas does not enter the nozzle 12 due to the cam shaped valve 14.

Figure 6A:
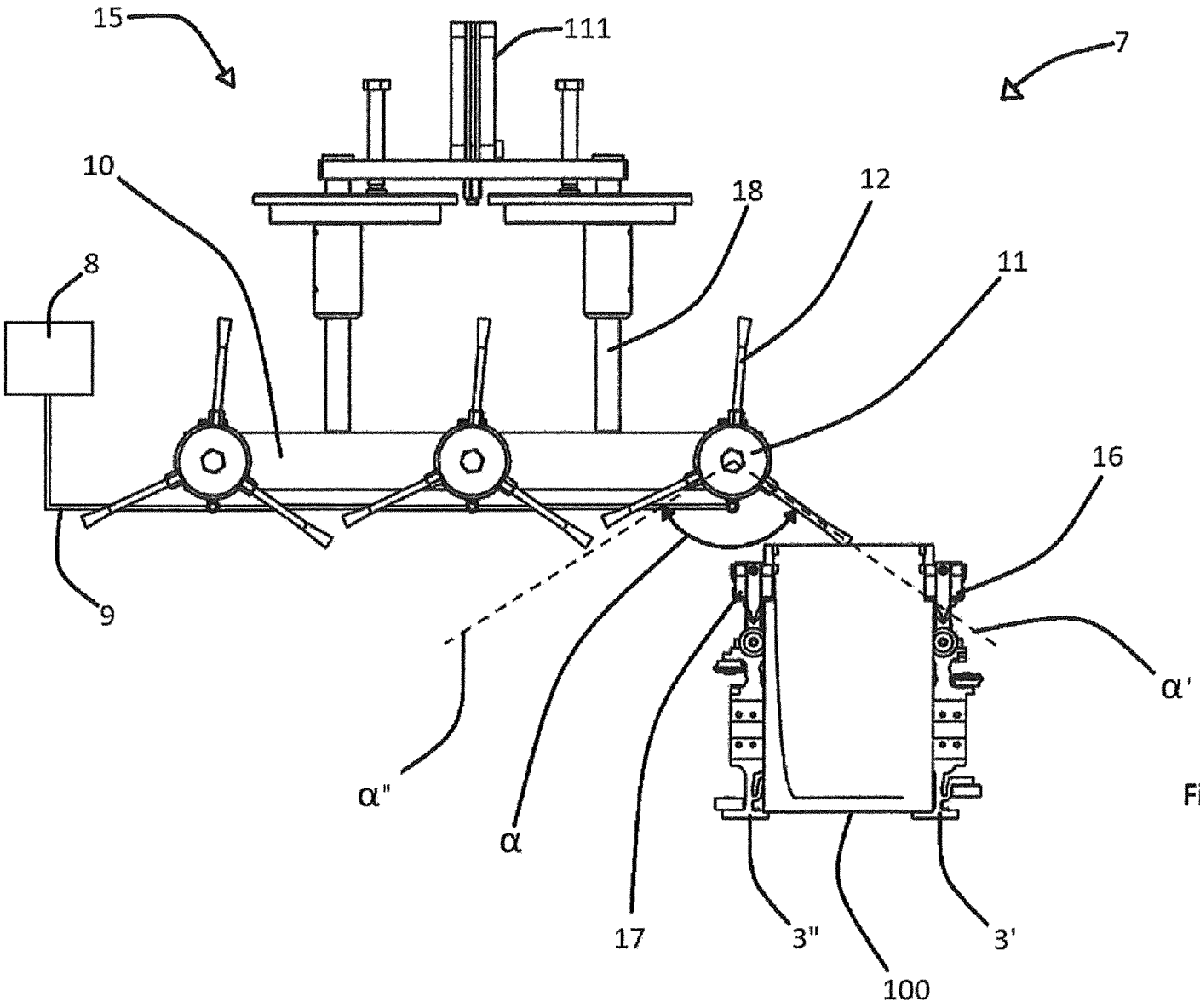
FIGS. 6A and 6B are a front schematic view of the air evacuation device during operation.
Figure 6B:
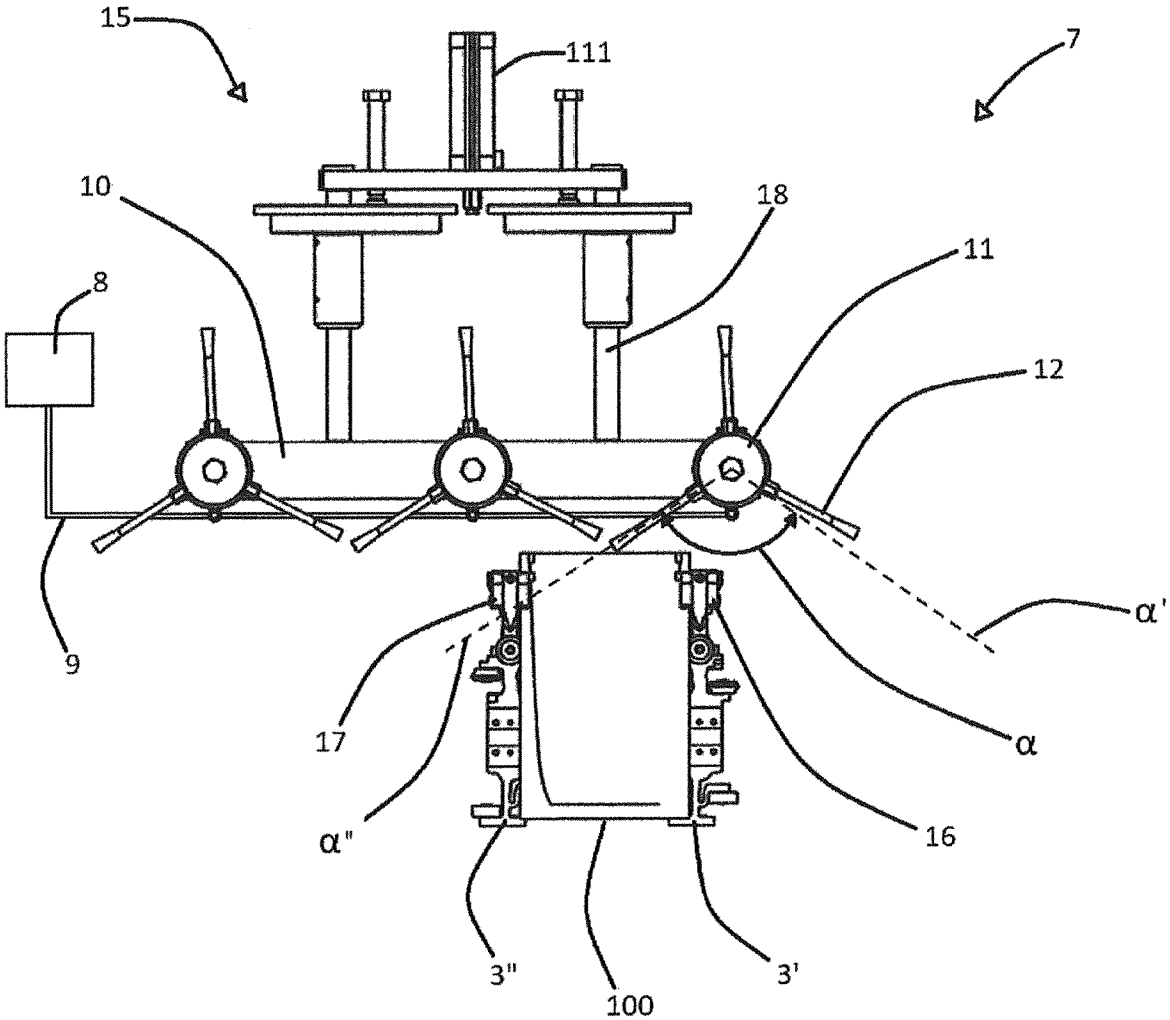

The insufflation system 7 is configured to allow the release of the gas from the insufflation orifice 13 of the at least one nozzle 12 when the latter is in proximity to or within the aperture 106 of the package 100, along the arc of circumference $\alpha$ ranging from a first axis $\alpha'$ to a second axis $\alpha''$ as visible in FIGS. 6A and 6B.

According to the present invention, said transport means 3 are configured to move said package 100 along the processing direction L, preferably seamlessly, while said at least one rotating head 11 is configured to be rotatably moved in a coordinated manner with the transport means 3, in such a way that the at least one nozzle 12 enters within the package 100 through said aperture 106 and rotates along the arc of circumference $\alpha$ between the first insufflation axis $\alpha'$, in which the insufflation orifice 13 is oriented to eject gas towards the first lateral portion 103 to the second insufflation axis $\alpha''$, in which the insufflation orifice 13 is oriented to ejects gas towards the second lateral portion 104.

Specifically, referring to a single rotating head 11 and a single nozzle 12, the positioning of the nozzle 12 with respect to the package 100 during its movement allows the nozzle to enter at least partially into the package 100 with an inclination along the insufflation axis $\alpha'$ as the initial point of introduction of the gas flow inside the package. The first axis $\alpha'$ preferably has an orientation such that the flow is initially directed towards the first lateral portion 103. The second axis $\alpha''$ preferably has an orientation such that the flow is finally directed towards the second lateral portion 104 and then exits the package 100 from the 106.

According to an embodiment, of the present invention the at least one nozzle 12 of the insufflation system 7 is configured to insufflate gas through the insufflation orifice 13 only when the latter is in the package 100.

According to another embodiment, the at least one nozzle 12 of the insufflation system 7 is configured to begin to insufflate gas through the insufflation orifice 13 when the latter is approaching the aperture 106 of the package 100 and before the orifice 13 is actually entered within the package 100.

The at least one nozzle 12 is moved in rotation by the at least one rotating head 11 while the conveyor system 2 moves the package 100.

In this way, the gas is insufflated inside the package 100 by 'sweeping' the entire volume inside it, thus completely replacing the air in the package 100 with the insufflated gas.

According to a specific embodiment and as shown in the illustrated example, the insufflation system 7 is provided with a plurality of rotating heads 11, in the example there are three, each provided with at least one nozzle 12.

The plurality of rotating heads 11 is preferably arranged in a row on the support 10 along an axis parallel to the processing direction L so that the corresponding rotation axes (R1, R2 . . . ) are substantially parallel to each other and perpendicular to the processing direction L.

Preferably the at least one rotating head 11 is provided with a plurality of nozzles 12 arranged equidistant from each other along a circumference, three in the example. According to an embodiment, the plurality of nozzles 12 arranged on the at least one rotating head 11 may be configured to insufflate gas from one or more nozzles 12 simultaneously. In the event that the insufflation system 7 is provided with a plurality of rotating heads 11 one or more of said rotating heads 11 may be provided with a plurality of nozzles 12.

Figure 4:
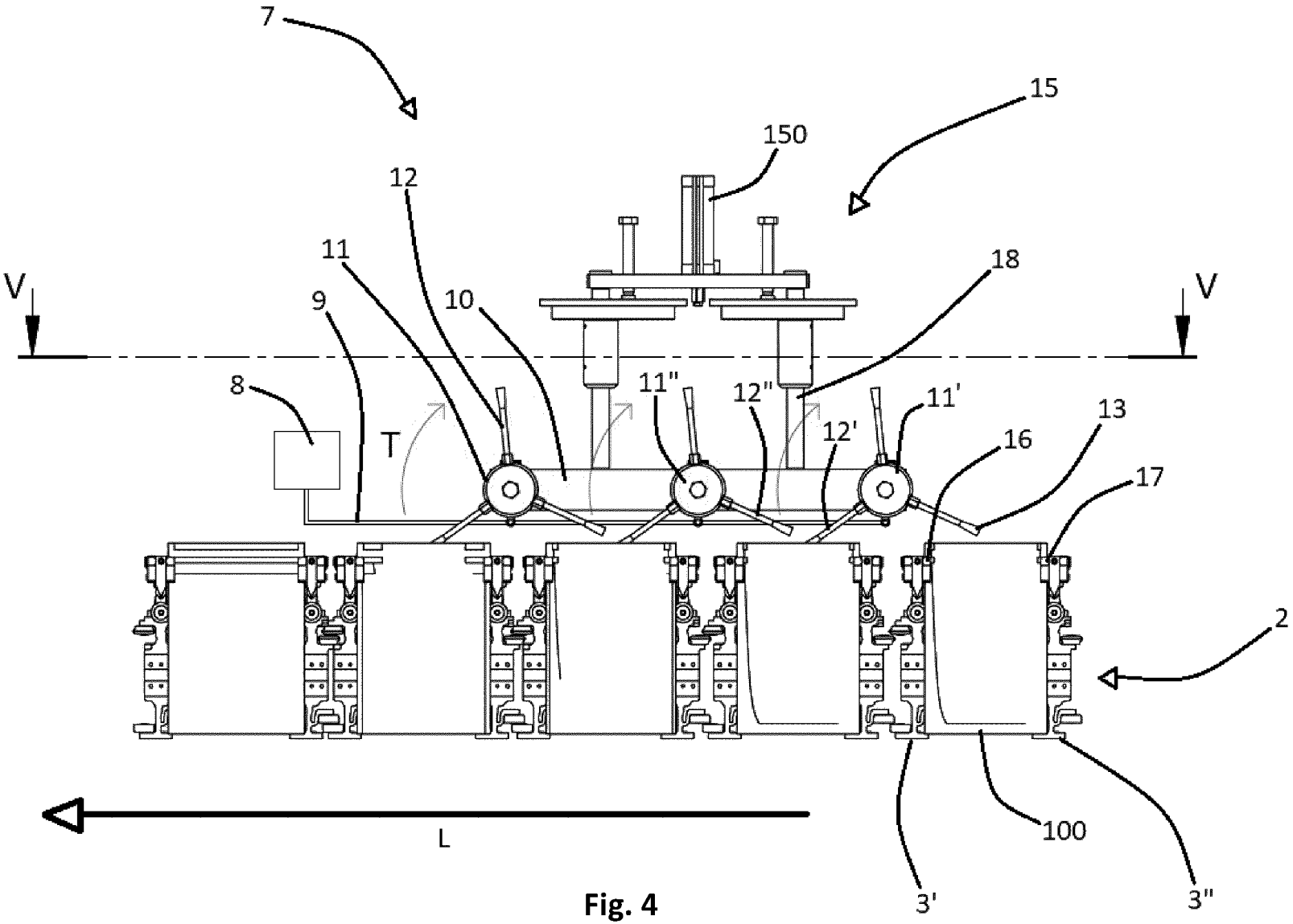
FIG. 4 is a frontal schematic view of the air evacuation device according to the invention.
Figure 5:
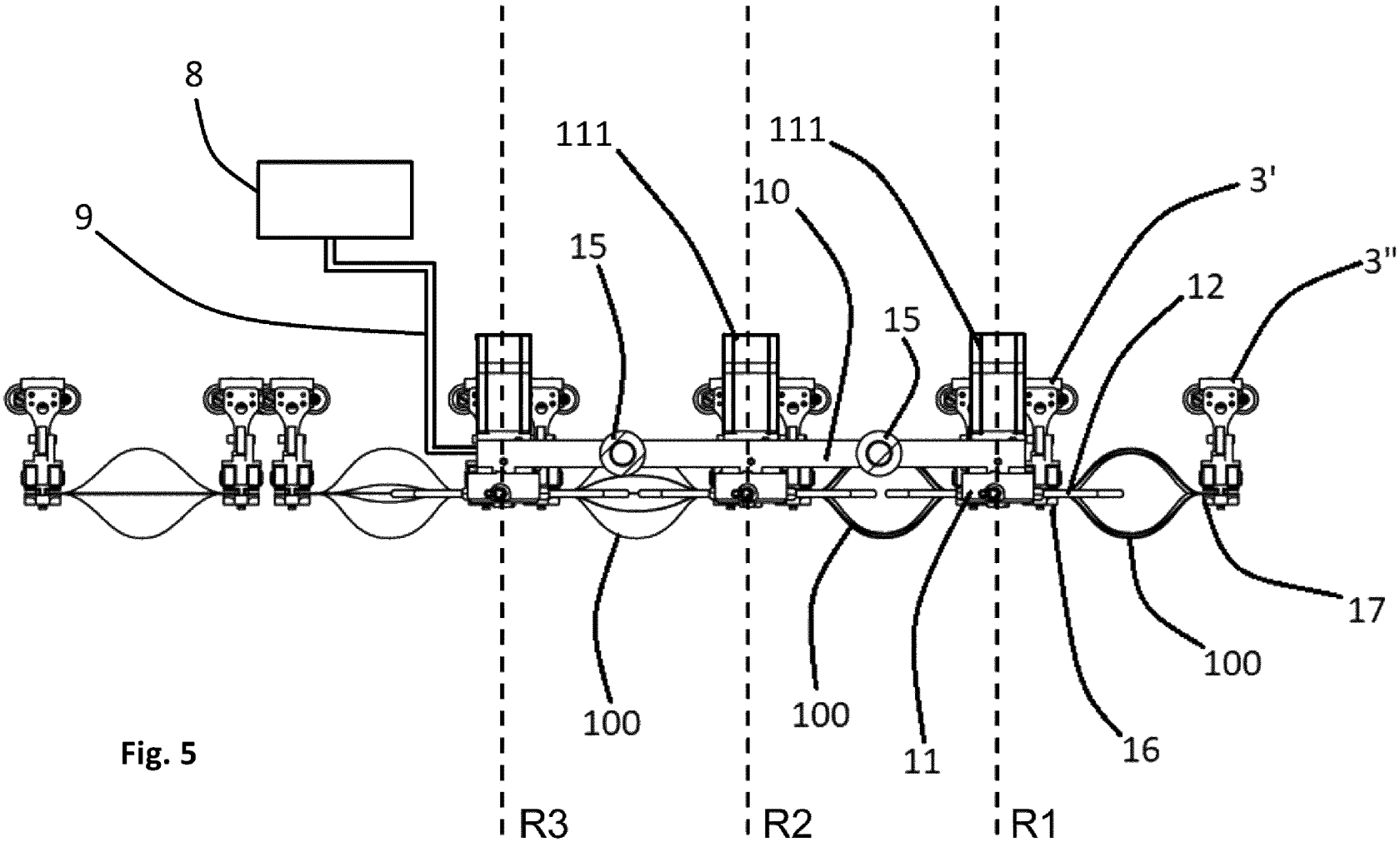
FIG. 5 is a view along the V-V section of FIG. 4.

According to a further embodiment, which can be seen in FIG. 4, when the insufflation system 7 comprises a plurality of rotating heads 11, these are configured and positioned so that a first nozzle 12' of a first rotating head 11' of said plurality of rotating heads 11 and a second nozzle 12" of a second rotating head 11" of said plurality of rotating heads 11 adjacent to said first rotating head 11', are placed at a distance and configured to be rotated in coordination with each other, in such a way that the second nozzle 12" enters into the package 100 through the aperture 106 before the first nozzle 12' has completely exited from the package 100 through the aperture 106.

In this way, the interior of the package is continuously insufflated with gas for a sufficient time to ensure a complete exchange of the air within the package 100 with the insufflated gas, while at the same time preventing air from re-entering from outside during the insufflation process.

According to another embodiment, the insufflation system 7 comprises adjusting means 15 configured to adjust the position of said at least one rotating head 11 with respect to said transport means 3. Said adjusting means preferably comprising an actuator 150 associated with the support 10 by means of slide rails 18.

Said adjusting means 15 allow a vertical movement of the support 10 and therefore of the rotating heads 11 along an axis perpendicular to the axis R of rotation of the at least one rotating head 11. More generally, said adjusting means 15 can be any mechanical means allowing a predetermined vertical displacement of said support 10 such as, for example, toothed wheels, threaded rods or pneumatic pistons.

According to a further embodiment, said first 16 and second 17 gripping elements are configured to be moved away from each other to close the aperture 106 before the at least one nozzle 12 has completely exited the package 100 through said aperture 106.

The apparatus 200 comprises sealing means 19 positioned downstream of the device 1 and configured to seal the aperture 106 of the package 100.

More specifically the sealing means 19 are configured to seal the aperture 106 when the package is held by the first 16 and the second 17 gripping member in the spanned position.

The method according to the invention for evacuating air from a package comprises the following steps:

providing a package 100 having a closed bottom 105, at least a first 101 and a second 102 walls opposed to each other and joined along a first 103 and a second 104 lateral opposite portions, said at least a first 101 and a second 102 walls defining along an upper edge thereof an aperture 106 opposed to said bottom 105;

providing a conveyor system 2 comprising a plurality of conveying means 3 configured to move said package 100 along a processing direction L;

providing an insufflation system 7 comprising a gas supply unit 8, a gas transport pipeline 9 connected to said gas supply unit 8 and at least one rotating head 11 positioned in a processing station 4 and configured to rotate about an axis R of rotation, said at least one rotating head 11 being provided with at least one nozzle 12 connected to said gas transport pipeline 9 and having a body extending along a longitudinal axis A substantially perpendicular with respect to the axis R of rotation, with a proximal end attached to said rotating head 11 and a distal end provided with an insufflation orifice 13;

moving said package 100 by said conveying means 3 from an arrival zone 5 to a release zone 6 passing through said processing station 4;

insufflating gas inside said package 100 with said insufflation orifice 13 of said nozzle 12.

In accordance with the invention, said insufflating step has been carried out by rotating the at least one nozzle 12 along an arc of circumference $\alpha$ between a first insufflation axis $\alpha'$ to a second insufflation axis $\alpha''$ wherein, in said first insufflation axis $\alpha'$, the insufflation orifice 13 enters within the package 100 and ejects gas towards the first lateral portion 103, and in said second insufflation axis $\alpha''$, the insufflation orifice 13 exits the package 100 while ejecting gas towards the second lateral portion 104, said insufflating step occurring while said package 100 is moved by said conveyor system 2 along the processing direction L.

According to an embodiment, the arc of circumference $\alpha$ subtends an angle between 60° and 120°.

Preferably said insufflation system 7 comprises a plurality of rotating heads 11, wherein a first nozzle 12' of a first rotating head 11' and a second nozzle 12" of a second rotating head 11" adjacent to said first rotating head 11' are rotatably moved in coordination with each other, in such a way that the second nozzle 12" enters into the package 100 through the aperture 106 before the first nozzle 12' has completely exited from the package 100 through the aperture 106 of said package 100.

According to a further embodiment, said first and second lateral portions 103, 104 of said package 100 are moved away from each other to near said first 101 and second wall 102 while said at least one nozzle 12 exits the package through the aperture 106.

In the following claims, the references in brackets are for the sole purpose of facilitating reading and should not be considered as limiting factors as to the scope of protection underlying the specific claims.

The invention claimed is:

1. A device for evacuating air from a package, the package having a closed bottom, at least a first and a second wall opposed to each other and joined together along a first and a second opposite lateral portion, said at least first and second walls defining along their upper edge an aperture at an end opposite said closed bottom, said device comprising:

a conveyor system comprising a plurality of conveying means configured to suspend said package in a hanging orientation and to move said package from an arrival zone to a release zone through at least one processing station along a processing direction (L);

an insufflation system comprising a gas supply unit, a gas transport pipeline connected to said supply unit, and at least one rotating head positioned in said at least one processing station and configured to rotate about an axis (R) of rotation, said at least one rotating head being provided with at least one nozzle connected to said gas transport pipeline and having a body extending along a longitudinal axis (A) substantially perpendicular with respect to the axis of rotation (R), with a proximal end attached to said at least one rotating head and a distal end provided with an insufflation orifice;

wherein said conveying means are configured to move said package along the processing direction (L), while said at least one rotating head is configured to be rotatably moved in a coordinated manner with movement of said conveying means, such that said at least one nozzle enters into an interior of the package through said aperture and rotates within the package along an arc of circumference (α) between a first insufflation position (α'), in which the insufflation orifice is oriented to eject gas directly towards the first lateral portion, and a second insufflation position (α"), in which the insufflation orifice is oriented to eject gas directly towards the second lateral portion, said at least one nozzle insufflating gas within the package while rotating along said are of circumference (α), and wherein said conveying means are configured to maintain said aperture in an open configuration while said at least one nozzle enters and rotates within the package, wherein said conveying means comprise a first gripping element configured to hold said first lateral portion of said package and a second gripping element configured to hold said second lateral portion of said package, and wherein said first and second gripping elements are configured to maintain an open position while said at least one nozzle rotates within the package and insufflates gas, and are further configured to be moved away from each other to transition to a closed configuration before said at least one nozzle has completely exited the package through said aperture.

2. The device according to claim 1, wherein said arc of circumference (a) subtends an angle between 60° and 120°.

3. The device according to claim 1, wherein said at least one rotating head is provided with a plurality of nozzles arranged equidistant from each other along a circumference.

4. The device according to claim 1, wherein said insufflation system comprises a plurality of rotating heads each provided with at least one respective nozzle.

5. The device according to claim 4, wherein a first nozzle of a first rotating head of said plurality of rotating heads and a second nozzle of a second rotating head of said plurality of rotating heads adjacent to said first rotating head are configured to be rotated in coordination with each other, such that the second nozzle enters the package through the aperture before the first nozzle has completely exited the package through the aperture.

6. The device according to claim 1, wherein said insufflation system further comprises adjusting means configured to adjust the position of said at least one rotating head with respect to said conveying means.

7. The device according to claim 6, wherein said at least one rotating head is mounted on a support which is movable by said adjusting means.

8. The device according to claim 1, wherein said first and second gripping elements are movable between said open position in which the first and second gripping elements are brought closer to each other to separate the first and second walls and maintain the aperture in said open configuration to allow entry of said at least one nozzle into the interior of the package, and a closed position in which the first and second gripping elements are spaced apart from each other to bring the first and second walls closer and bring the aperture to said closed configuration.

9. The device according to claim 1, wherein said conveying system comprises a closed track and said plurality of conveying means are configured to be moved along the track by interaction of magnetic fields.

10. An apparatus for packaging a package in a modified atmosphere, wherein the package includes a closed bottom, at least a first and a second wall opposed to each other and joined together along a first and a second opposite lateral portion, said at least first and second walls defining along their upper edge an aperture opposite said closed bottom, said apparatus comprising:

a device for evacuating air from the package wherein the device includes:

a conveyor system comprising a plurality of conveying means configured to suspend said package in a hanging orientation and to move said package from an arrival zone to a release zone through at least one processing station along a processing direction (L);

an insufflation system comprising a gas supply unit, a gas transport pipeline connected to said supply unit and at least one rotating head positioned in said at least one processing station and configured to rotate about an axis (R) of rotation, said at least one rotating head being provided with at least one nozzle connected to said gas transport pipeline and having a body extending along a longitudinal axis (A) substantially perpendicular with respect to the axis of rotation (R), with a proximal end attached to said at least one rotating head and a distal end provided with an insufflation orifice;

wherein said conveying means are configured to move said package along the processing direction (L), while said at least one rotating head is configured to be rotatably moved in a coordinated manner with movement of said conveying means, such that said at least one nozzle enters into an interior of the package through said aperture and rotates within the package along an arc of circumference (a) between a first insufflation position (a'), in which the insufflation orifice is oriented to eject gas directly towards the first lateral portion, and a second insufflation position (a"), in which the insufflation orifice is oriented to eject gas directly towards the second lateral portion, said at least one nozzle insufflating gas within the package while rotating along said arc of circumference (a), and wherein said conveying means are configured to maintain said aperture in an open configuration while said at least one nozzle enters and rotates within the package; and sealing means positioned downstream of the device for evacuating air and configured to seal the aperture of the package; wherein said conveying means comprise a first gripping element configured to hold said first lateral portion of said package and a second gripping element configured to hold said second lateral portion of said package, and wherein said first and second gripping elements are configured to maintain an open position while said at least one nozzle rotates within the package and insufflates gas, and are further configured to be moved away from each other to transition to a closed configuration before said at least one nozzle has completely exited the package through said aperture.

11. A method for evacuating air from a package, said method comprising the steps of:

providing a package having a closed bottom, at least a first and a second wall opposed to each other and joined along a first and a second opposite lateral portion, said at least first and second walls defining along an upper edge thereof an aperture at an end opposite said bottom;

providing a conveyor system comprising a plurality of conveying means configured to suspend said package in a hanging orientation and to move said package along a processing direction (L);

providing an insufflation system comprising a gas supply unit, a gas transport pipeline connected to said gas supply unit, and at least one rotating head positioned in a processing station and configured to rotate about an axis of rotation (R), said at least one rotating head being provided with at least one nozzle connected to said gas transport pipeline and having a body extending along a longitudinal axis (A) substantially perpendicular with respect to the axis of rotation (R), with a proximal end attached to said rotating head and a distal end provided with an insufflation orifice;

moving said package by said conveying means from an arrival zone to a release zone passing through said processing station;

insufflating gas within said package with said insufflation orifice of said nozzle;

wherein said step of insufflating is carried out by rotating the at least one nozzle along an arc of circumference ($\alpha$) between a first insufflation position ($\alpha'$) and a second insufflation position ($\alpha''$) wherein, in said first insufflation position ($\alpha'$), the insufflation orifice enters into the interior of the package and ejects gas directly towards the first lateral portion, and in said second insufflation position ($\alpha''$), the insufflation orifice rotates within the package while ejecting gas towards the second lateral portion, said step of insufflating occurring while said package is moved by said conveying means along the processing direction (L), and wherein said conveying means maintain said aperture in an open configuration while said at least one nozzle enters and rotates within the package, and wherein said first and second lateral portions of said package are moved away from each other to bring said first and second walls closer together and close the aperture while said at least one nozzle exits the package through the aperture.

12. The method according to claim 11, wherein said arc of circumference ($\alpha$) subtends an angle between 60° and 120°.

13. The method according to claim 11, wherein said insufflation system comprises a plurality of rotating heads, wherein a first nozzle of a first rotating head and a second nozzle of a second rotating head adjacent to said first rotating head are rotatably moved in coordination with each other, such that the second nozzle enters the package through the aperture before the first nozzle has completely exited the package through the aperture.

* * * * *